US005704144A

United States Patent [19]

Groth

[11] Patent Number: 5,704,144

[45] Date of Patent: Jan. 6, 1998

[54] BEVERAGE CONTAINER IDENTIFICATION TAG

[76] Inventor: Francis R. Groth, 21620 Alexander, St. Clair Shores, Mich. 48081

[21] Appl. No.: 653,704

[22] Filed: May 23, 1996

[51] Int. Cl.[6] ..... G09F 3/00

[52] U.S. Cl. ..... 40/306; 40/638; 40/665

[58] Field of Search ..... 40/306, 310, 324, 40/630, 633, 638, 665; 283/81

[56] References Cited

U.S. PATENT DOCUMENTS

| | | | |
|---|---|---|---|
| 2,844,893 | 7/1958 | Keller | 40/306 |
| 3,382,779 | 5/1968 | Lynas | 40/310 X |
| 3,750,317 | 8/1973 | Morgan | 283/81 X |
| 3,854,581 | 12/1974 | Jones, Jr. . | |
| 4,171,864 | 10/1979 | Jung et al. . | |
| 4,991,337 | 2/1991 | Solon | 40/633 |
| 5,358,770 | 10/1994 | Evans | 40/310 X |

FOREIGN PATENT DOCUMENTS

| | | | |
|---|---|---|---|
| 140255 | 9/1948 | Australia | 40/324 |
| 647042 | 3/1991 | Australia | 40/324 |
| 21822 | of 1908 | United Kingdom | 40/310 |

*Primary Examiner*—Brian K. Green

*Attorney, Agent, or Firm*—Peter D. Keefe; William D. Blackman

[57] ABSTRACT

A beverage container identification tag for attaching to a beverage container to allow a drinker or others to identify the ownership of the beverage stored in the beverage container. The beverage container identification tag includes a tag body made of a thin strip of a flexible material for wrapping around a beverage container. The beverage container identification tag also includes a display area for placement thereon identifying indicia, such as for example a name or other symbol. One end of the tag body carries a tacky adhesive, which is used to connect that end to a selected overlapped location on the tag body after it is wrapped snugly around a beverage container.

1 Claim, 1 Drawing Sheet

BEVERAGE CONTAINER IDENTIFICATION TAG

BACKGROUND OF THE INVENTION

1. Field of the Invention

The present invention relates to identification tags for providing visual identification of personal possessions. More particularly, the present invention relates to a customizable identification tag for engirding placement on a beverage container.

2. Description of the Prior Art

Often, at a party or other social setting where people are mixing and mingling, numerous people are drinking coffee, soda, beer, or other liquid refreshments. Many times, an individual set his or her drink down momentarily and will return to it later. Sometimes, either that person becomes unsure where the drink was placed, or finds that two or more similar appearing drinks have been left in an area, and it becomes difficult to tell which drink belongs to whom. Accidentally picking-up and drinking another person's drink can pose a risk of exposure to any contagious medical condition that the other person may have, and in general, it is also impolite to drink from another person's beverage container.

Identification tags or labels are available for luggage, as well as for keys, books, and some other personal property. Some items, like books, can be directly written on to identify ownership thereof. However, there is a need in the art for a simple, easily applied identification tag for a person to place on a beverage container to identify its owner, for their own reference as well as others. Preferably, such a beverage container identification tag would be water resistant and reusable two or more times, to save on costs and to preserve resources.

SUMMARY OF THE INVENTION

The present invention provides a beverage container identification tag for engirdably attaching to a beverage container to allow people to identify the ownership of a drink stored in the beverage container.

A beverage container identification tag according to the present invention includes a thin strip of flexible material structured for being wrapped around a beverage container. The beverage container identification tag has a first side and an opposed second side having a display area. The beverage container identification tag also has a first end and a second end, wherein either one of the ends carries a tacky adhesive which is used to connect the ends of the strip together after it has been wrapped around a sidewall of a beverage container. The beverage container identification tag has a releasable cover sheet for protectively covering the tacky adhesive, the cover sheet being peeled therefrom at the time of placement of the beverage container identification tag onto a beverage container.

The present invention also contemplates a kit which includes a plurality of beverage container identification tags, and a writing instrument for writing identifying indicia, such as a name or initials, on the beverage identification tags as needed to provide identification.

Accordingly, it is an object of the present invention to enable an individual to differentiate between his or her own beverage container and a similar appearing beverage container belonging to another person, by the use of a beverage container identification tag.

It is a further object of the present invention to provide a beverage container identification tag which can be adjusted at least one time to fit the perimeter of a beverage container, within a given range of circumferences.

It is yet a further object of the present invention to provide a beverage container identification tag which can be reused two or more times.

It is still a further object of the present invention to provide a kit which includes a plurality of beverage container identification tags, and a writing instrument for writing identifying indicia on the beverage container identification tags.

These, and additional objects, advantages, features and benefits of the present invention will become apparent from the following specification.

DETAILED DESCRIPTION OF THE PREFERRED EMBODIMENT

Figure 1:
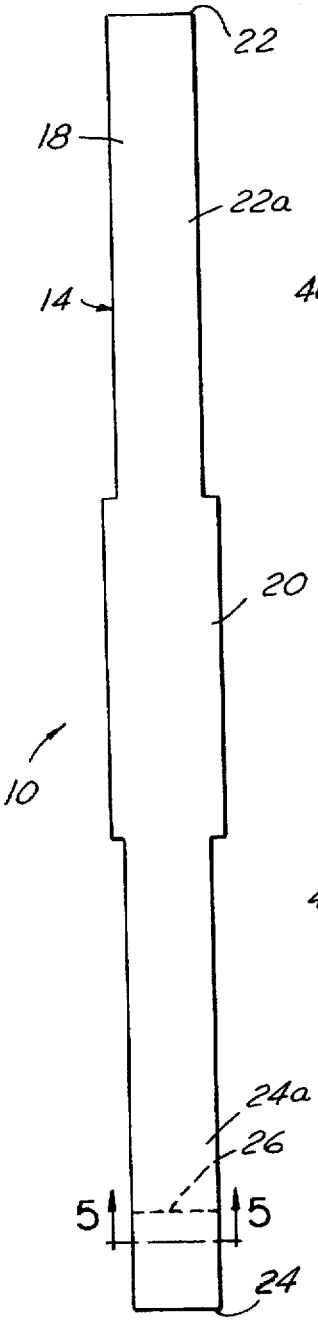
FIG. 1 is a plan view of a beverage container identification tag in accordance with the present invention.
Figure 2:
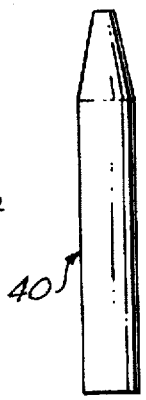
FIG. 2 is a side view of a writing instrument in the exemplary form of a crayon.

Referring now to the Drawing, a beverage container identification tag 10 is shown for engirdingly attaching to a beverage container 12 to allow a person, such as the drinker of the beverage in the beverage container (or others), to identify the usership of the beverage container 12. In this regard, a user (not shown) writes identifying indicia, such as a name or initials, on the beverage container identification tag 10 and then wraps the beverage container identification tag around a beverage container 12, and adhesively attaches an end of the beverage container identification tag to an overlapped portion thereof, as will be discussed in further detail herein, to thereby identify his or her beverage container.

Figure 3:
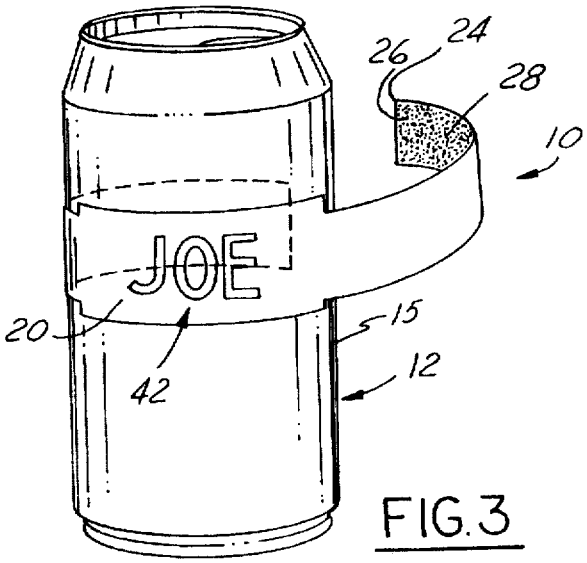
FIG. 3 is a perspective view of a beverage container showing the beverage container identification tag according to the present invention being wrapped therearound, wherein a name has been marked on the beverage container identification tag by the writing instrument.
Figure 4:
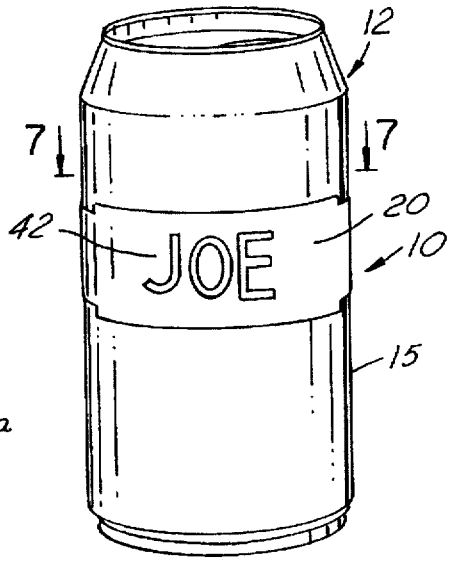
FIG. 4 is a perspective view of the beverage container of FIG. 3 after the beverage container identification tag has been installed thereon.
Figure 5:
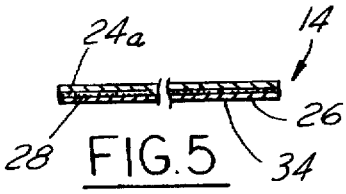
FIG. 5 is a cross-sectional view of the beverage container identification tag, taken along the line 5—5 of FIG. 1.

The beverage container identification tag 10 includes a tag body 14 which is a strip of preferably nonelastic, impermeable, flexible material, having a thickness which is thin in relation to its width, for wrapping around a sidewall 15 of a beverage container 12 (see FIG. 3). As used herein, the term "impermeable" means a continuous surface formed of a waterproof material. The beverage container identification tag 10 hereof is structured to wrap around different types and sizes of beverage containers, such as for example coffee mugs, disposable cups, aluminum cans, glasses, bottles, etc. The tag body 14 is preferably formed of a material which will not structurally degrade while in contact with water, as for example caused by condensation collecting on the exterior of the beverage container 12. The tag body 14 is preferably formed of a nonelastic, impermeable, flexible plastic sheeting. A preferred plastic is polypropylene, such as for example "White 'PAPER MATCH' with Corona treatment" model number 0201/110, available from American Profol, Inc. of Cedar Rapids, Iowa 52409. Other suitable plastics may be used, such as for example styrene. Alternatively, while less preferred, the tag body 14 may be made of paper which has been coated with wax or plastic to make it water resistant.

The tag body 14 has a first side 16, a second side 18 having a display area 20, a first end 22 and a second end 24 opposite the first end. In the preferred embodiment, the tag body 14 has a first width at the end portions 22*a*, 24*a* thereof, and has a second width, which is wider than the first width, at the display area 20.

Figure 6:
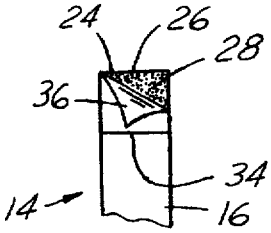
FIG. 6 is a cut-away view of an inner surface of an end of the beverage container identification tag according to the present invention, showing a releasable cover sheet being peeled therefrom.
Figure 7:
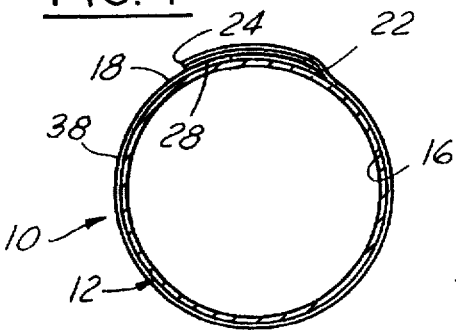
FIG. 7 is a partly cross-sectional view of the beverage container of FIG. 4 and the beverage container identification tag according to the present invention, taken along the line 7—7 in FIG. 4.

Referring now to FIG. 6, the first side 16 adjacent the second end 24 has a tacky adhesive 26 attached thereto. In the drawing and for purposes of illustration herein, the tacky adhesive 26 is shown attached to the first side 16 adjacent the second end 24, but as a practical matter, placement of the tacky adhesive 26 adjacent either end will suffice. The tacky adhesive 26 is preferably in the form of a two faced adhesive tape, wherein one tacky side of the adhesive tape is stuck onto to the first side 16 of the tag body 14 and the other tacky side 28 faces outwardly therefrom. The preferred two faced adhesive tape is model number DC-4309 paper manufactured by A. T. P. Company, located in Florida. Alternatively, the tacky adhesive 26 may be formed of a thin adhesive coating applied to the first side 16 of the tag body 14.

The beverage container identification tag 10 also includes a releasable cover sheet 34 which protectively covers the tacky side 28 of the tacky adhesive 26. The cover sheet 34 is peeled off from the tacky side 28 of the tacky adhesive 26 by a user of the beverage container identification tag 10, to thereby expose the tacky side of the tacky adhesive. In this regard, the cover sheet 34 has an inner surface 36 coated with a non-stick coating, wherein the inner surface abuts the tacky side 28 of the tacky adhesive 26.

To apply the beverage container identification tag 10 to a beverage container 12, the cover sheet 34 is peeled off of the tacky adhesive 26, and the beverage container identification tag 10 is wrapped snugly around the sidewall 15 of a selected beverage container 12 with the first side 16 of the tag body 14, which carries the tacky adhesive 26, facing inwardly toward the beverage container, wherein the tacky adhesive overlaps the first end 22. Thereupon, the tacky adhesive 26 is pressed against the second side 18 of the first end portion 22*a* of the tag body 14 so that the tacky side 28 of the tacky adhesive adheres thereto, thereby affixing the first side 16 at the second end portion 24*a* to the second side 18 at the first end portion 22*a*. Accordingly, the tag body 14 has, as a result, been formed into a band 38 snugly engirding the beverage container 12, whereby the beverage container identification tag 10 is held in place on the side wall 15 of the beverage container 12 by friction and/or abutment with any interfering structure of the beverage container, such as for example a handle. The tag body 14 is made of a sufficient length that the tacky adhesive 26 thereof will overlap the first end 22 when the tag body is wrapped around a beverage container having a sidewall within a predetermined range of sizes.

Either before or after the beverage container identification tag 10 has been applied to the beverage container 12 (preferably before), a writing instrument 40 is used to write identifying indicia 42, such as a name, initials, or other symbol on the display area 20 of the tag body 14 to identify ownership of the beverage in the beverage container 12.

The beverage container identification tag 10 hereof is preferably sold in a kit containing a plurality of unmarked beverage container identification tags 10 and a writing instrument 40 such as preferably for example a crayon, or alternatively a marker, pen, or other suitable writing instrument which is capable of making identifying indicia on the beverage identification tags as required. Preferably, the indicia made by the writing instrument 40 are insoluble in water-based solutions to avoid smudging thereof if the beverage container identification tag 10 is exposed to water or to a spilled beverage.

A nonlimiting exemplification of material and dimensional geometry of the beverage identification tag will now be given. The tag body 14 is composed of polypropylene, and is about 11.5 inches long, wherein the display area 20 is about 3 inches long, and the first and second end portions 22*a*, 24*a* are each about 4.25 inches long. The cross-section of the display area is about 1 inch and the cross-section of the first and second end portions are each about 0.75 inch. The tag body is about nine-thousandths (0.009) inch thick. Finally, the adhesive is a two faced (i.e. double coated) tape about three-quarters of an inch square.

To those skilled in the art to which this invention appertains, the above described preferred embodiment may be subject to change or modification. For example, the display area may be located on either or both the fist and second sides of the tag body. Further for example, the tag body can be wrapped around the beverage container with the tacky adhesive facing away from the sidewall and facing toward an overlapping section of the tag body. Such change or modification can be carried out without departing from the scope of the invention, which is intended to be limited only by the scope of the appended claims.

What is claimed is:

1. A method for providing customized identification of a beverage container, comprising the steps of:

wrapping a thin strip of nonelastic, impermeable, flexible, water resistant sheeting tightly around a first beverage container;

attaching one end of the thin strip to a selected location of the thin strip whereat the one end is in overlapping relation, thereby snugly engirding the first beverage container with the thin strip;

marking the thin strip with at least one indicium, where the at least one indicium is visible after said step of wrapping;

wherein the thin strip snugly engirds the first beverage container such that the thin strip is held in place on the first beverage container;

detaching the one end of the thin strip from the selected location of the thin strip;

removing the thin strip from the first beverage container;

wrapping the thin strip tightly around a second beverage container; and attaching the one end of the thin strip to a selected location on the thin strip whereat the one end is in overlapping relation, thereby snugly engirding the second beverage container with the thin strip;

where the thin strip snugly engirds the second beverage container such that the thin strip is held in place on the second beverage container.

* * * * *